US005617925A

United States Patent [19]

Boothby et al.

[11] Patent Number: 5,617,925

[45] Date of Patent: Apr. 8, 1997

[54] ASSEMBLY FOR DECELERATING A DRIVER IN A TOOL

[75] Inventors: Terry A. Boothby, Cincinnati; Delbert E. Lucas, Fairfield, both of Ohio

[73] Assignee: Sencorp, Newport, Ky.

[21] Appl. No.: 463,848

[22] Filed: Jun. 5, 1995

[51] Int. Cl.[6] ..... B25D 1/12; B25C 1/08

[52] U.S. Cl. ..... 173/211; 173/210; 227/10

[58] Field of Search ..... 227/9, 10, 11, 227/130; 173/210, 211

[56] References Cited

U.S. PATENT DOCUMENTS

| | | | |
|---|---|---|---|
| 3,645,091 | 2/1972 | Ivanov et al. | 227/9 X |
| 3,678,808 | 7/1972 | Hsu et al. | 92/85 |
| 3,804,314 | 4/1974 | Gilbert | 227/10 |
| 3,828,656 | 8/1974 | Biddle et al. | 92/85 |
| 3,969,988 | 7/1976 | Maurer | 92/19 |
| 3,969,989 | 7/1976 | Maurer et al. | 92/85 R |
| 4,122,987 | 10/1978 | Jochum et al. | 227/10 |
| 4,134,527 | 1/1979 | Termet | 227/10 |
| 4,332,340 | 6/1982 | Harris | 227/10 |
| 4,441,644 | 4/1984 | Farian | 227/130 |
| 4,492,329 | 1/1985 | Benson et al. | 227/10 |
| 4,824,003 | 4/1989 | Almeras et al. | 227/10 |
| 5,553,764 | 9/1996 | Remerowski | 227/10 |

FOREIGN PATENT DOCUMENTS

| | | |
|---|---|---|
| 0410928 | 7/1990 | European Pat. Off. . |
| 3930592 | 9/1990 | Germany . |
| 3924620 | 1/1991 | Germany . |
| 3923612 | 1/1991 | Germany . |
| 3924621 | 1/1991 | Germany . |
| 9008629 | 8/1990 | WIPO . |

*Primary Examiner*—Joseph J. Hall, III
*Assistant Examiner*—Jay A. Stelacone
*Attorney, Agent, or Firm*—Jerrold J. Litzinger

[57] ABSTRACT

A tool for driving a nail or other fastener is actuated by a caseless propellant charge formed of combustible material that is transported into a combustion chamber on a strip. The propellant charge is ignited by striking a sensitizer portion of the charge at an oblique angle. The ignition member intermixes the sensitizer material with an oxidizer layer of the surface of the propellant charge, resulting in combustion of the charge. When ignited, the propellant charge is compressingly interposed between an orifice plate and a movable portion of the combustion chamber. The orifice plate includes a pedestal with an annular compression surface that separates the surface of the ignition area from the remaining surfaces of the charge, insuring that ignition gases are forced through the charge. An annular C-shaped ring is interposed between the orifice plate and the movable portion of the combustion chamber. When the charge is ignited, the resulting gas pressure resiliently expands the annular C-shaped ring and urges opposite axial ends of the C-shaped ring into sealing relationship between the relatively movable components of the combustion chamber. Combustion gases are communicated through orifices in the orifice plate to a cylinder where the gases force movement of a driver, which driver strikes and drives a fastener such a nail. The driver is reciprocally movable within the cylinder and is returned to its precombustion position by a gas spring return cylinder. The gas return cylinder in mechanically interconnected to the driver and contains a sealed gaseous fluid that is independent of and segregated from fluids in the combustion chamber. An assembly for deaccelerating the driver includes a series of spaced and aligned progressively sized metal cup members of progressively increasing mass, contact surface area and interface angles.

19 Claims, 3 Drawing Sheets

ASSEMBLY FOR DECELERATING A DRIVER IN A TOOL

TECHNICAL FIELD

The present invention is directed generally to driving tools and, more particularly, to propellant driving tools of the type which use propellant charges to drive a fastener or other object. The invention will be specifically disclosed in connection with a driving tool that ignites a caseless propellant charge and uses the resulting combustion gases to drive a nail.

BACKGROUND OF THE INVENTION

The majority of the fastener driving tools in use today are pneumatically powered. Pneumatic tools use a source of pressurized air that is supplied to the tool through a hose. This is a severe limitation on the versatility of pneumatic tools; they must be tied to a source of air pressure by a hose, limiting the distance which the tools can be moved from the air source. In addition, some remote job sites make it difficult to provide an easily accessible and economical air source. The added expense of providing electrical service to power the air source, or using alternative power sources (such as gasoline powered compressors) for providing the compressed air, subtract from the efficiency and convenience that pneumatic tools traditionally provide. Therefore, there have been many attempts to provide alternatives to pneumatically actuated tools that can be used in situations where the pneumatic tools are not convenient.

One alternative that has been developed is a tool which uses electricity to provide the power needed to drive fasteners of the type and size that traditionally pneumatic tools drive. Most of these tools use an electric motor to power one or more flywheels which, in turn, store sufficient energy to drive the fasteners. Examples of these tools are set forth in U.S. Pat. Nos. 4,042,036; 4,121,745; 4,204,622; 4,298,072; 4,323,127; and 4,964,558. However, these tools still suffer from the same limitation as the pneumatic tools in that they must be connected by a cord to an energy source.

A second alternative which has recently been developed is a completely self-contained fastener driving tool which is powered by internal combustion of a gaseous fuel-air mixture. Examples of these tools are found in U.S. Pat. Nos. 2,898,893; 3,042,008; 3,213,608; 3,850,359; 4,075,850; 4,200,213; 4,218,888; 4,403,722; 4,415,110; and 4,739,915. While these tools need no connection to an external power source and are extremely versatile, they tend to be somewhat large, complex, heavy and awkward to use. In addition, they can be less economical to operate in that the fuel used is relatively expensive.

Another class of tools which is traditionally used as an alternative to pneumatic tools is the powder or propellant actuated tool. Powder or propellant actuated fastener driving tools are used most frequently for driving fasteners into hard surfaces such as concrete. The most common types of such tools are traditionally single fastener, single shot devices; that is, a single fasteners is manually inserted into the barrel of the tool, along with a single propellant charge. After the fastener is discharged, the tool must be manually reloaded with both a fastener and a propellant charge in order to be operated again. Examples of such tools are described in U.S. Pat. Nos. 4,830,254; 4,598,851; and 4,577,793.

In propellant actuated tools, there are many different type of cartridges used for propellants. For examples, U.S. Pat. No. 3,372,643 teaches a low explosive primerless charge consisting of a substantially resilient fibrous nitrocellulose pellet with an igniter portion and having a web thickness less than any other dimension of the pellet. U.S. Pat. No. 3,529,548 is directed to a powder cartridge consisting of a cartridge case constructed of two separate pieces which contain a central primer receiving chamber and an annular propellant receiving chamber. U.S. Pat. No. 3,911,825 discloses a propellant charge having an H-shaped cross section composed of a primer igniter charge surrounded by an annular propellant powder charge.

A second type of powder actuated tool has also been used in recent times. This tool still uses fasteners which are individually loaded-into the firing chamber of the device. However, the propellant charges used to provide the energy needed to drive the fasteners are provided on a flexible band of serially arranged cartridges which are fed one-by-one into the combustion chamber of the tool. Examples of this type of tool are taught in U.S. Pat. No. 4,687,126; 4,655,380; and 4,804,127. In the tools heretofore mentioned, which use a cartridge strip assembly, there are a variety of strips which are available for use. U.S. Pat. No. 3,611,870 is directed to a plastic strip in which a series of explosive charges are located in recesses in the strip with a press fit. U.S. Pat. No. 3,625,153 teaches a cartridge strip for use with a powder actuated tool which is windable into a roll about an axis which is substantially parallel to the surface portion of the strip and having the propellant cartridges disposed substantially perpendicular to the surface portion. U.S. Pat. No. 3,625,154 teaches a flexible cartridge strip with recesses for holding propellant charges, wherein the thickness of the strip corresponds to the length of the charge contained therein. U.S. Pat. No. 4,056,062 discloses a strip for carrying a caseless charge wherein the charge is held in the space by a recess and a tower-shaped wall and is disposed in surface contact with the annular surface within the cartridge recess. U.S. Pat. No. 4,819,562 describes a propellant containing device which has a plurality of hollow members closed at one end and a plurality of closure means each having a peripheral rim which fits into the open end of the hollow members of the device.

Recently, several powder actuated tools have been developed which operate in a manner similar to the traditional pneumatic tools; that is, these devices contain a magazine which automatically feeds a plurality of fasteners serially to the drive chamber of the tool, while a strip of propellant charges is supplied serially to the tool to drive the fasteners.

One example of such a tool is described in U.S. Pat. No. 4,821,938. This patent, which teaches an improved version of a tool taught in U.S. Pat. No. 4,655,380, is directed to a powder actuated tool with an improved safety interlock which permits a cartridge to be fired only when a safety rod is forced into the barrel and cylinder assembly and when the barrel and cylinder assembly has been forced rearwardly into its rearward position.

Another example of this type of tool is taught in U.S. Pat. No. 4,858,811. This tool, which is an improved version of the tool taught in U.S. Pat. No. 4,687,126, incorporates a handle, a tubular chamber, a piston, and a combustion chamber within the tubular chamber; the combustion chamber receiving a cartridge in preparation for firing, which upon ignition, propels the piston forwardly for the driving of a nail. A fastener housing is located forwardly of the tubular chamber, and is provided for directing a strip of fasteners held by a magazine upwardly through the tool during repeated tool usage.

Both of the aforementioned: recent powder actuated tools, however, are designed to drive fasteners into hard surfaces such as concrete. Consequently, a need exists for a propellant actuated tool that can be efficiently used as a replacement for traditional pneumatic tools which drive fasteners into wood.

It is thus an object of the present invention to overcome the disadvantages of the prior art by providing a propellant actuated fastener driving tool which is lighter, less complex, and very similar to the traditional pneumatic tool.

It is also an object of the present invention to provide a tool which can be easily and efficiently used in those work environments where pneumatic tools are traditionally used.

It is further an object of the present invention to provide a self-contained fastener driving tool which is safer and less expensive to operate than tools currently available and known in the art.

Additional objects, advantages, and other novel features of the invention will be set forth in pan in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention disclosed herein, an assembly is provided for deaccelerating a movable driver in a tool. The assembly includes a tool body having a driver therein movable in a predetermined direction. The driver has a conical contact surface facing the predetermined direction. The assembly further includes a first stop member having first and second conical contact surfaces. The first conical contact surface is adapted to receive the conical contact surface of the driver and is positioned to be contacted by the driver's conical contact surface as the driver is moved in the predetermined direction. The first stop member is movable in the predetermined direction upon being contacted by the conical contact surface of the driver. A second stop member has a first conical contact surface that is adapted to receive the second conical contact surface of the first stop member. The second stop member is positioned to be contacted by the second conical contact surface of the first member as the first stop member is moved in the predetermined direction. The second stop member is movable in the predetermined direction upon being contacted by the second conical contact surface of the first stop member. A resilient spacer provides a predetermined spacing between the first and second stop members prior to movement of the driver in the predetermined direction. The driver and the first and second stop members are configured and dimensioned such that substantially all of the contact force between the driver and the first stop member is applied through the conical contact surface of the driver and the first conical contact surface of the first stop member. Similarly, substantially all of the contact force between the first and second members is applied through the second conical contact surface of the first stop member and the first conical contact surface of the second stop member.

In a preferred form of the invention, the second stop member preferably also includes a second conical contact surface and the assembly further includes a third stop member having a conical contact surface. The conical contact surface of the third stop member is adapted to receive the second contact surface of the second stop member and is positioned to be contacted by the second conical contact surface of the second stop member as the second stop member is moved in the predetermined direction. A second resilient spacer is interposed between the second and third stop members for providing a predetermined spacing between the first and second stop members prior to movement of the second stop member in the predetermined direction.

According to another aspect of the invention, the stop assembly includes a plurality of serially aligned conically shaped metal stop members that interface with each other at predetermined acute interface angles. The stop member proximal to the driver contact surface forms a first predetermined acute interface angle with the driver contact surface and the stop member most distal to the driver contact surface forms a final interface angle with the stop structure. All of the interface angles between the metal stop members increase progressively in the direction from the first to the final interface angles.

Still other objects of the present invention will become apparent to those skilled in this art from the following description wherein there is shown and described a preferred embodiment of this invention, simply by way of illustration, of one of the best modes contemplated for carrying out the invention. As will be realized, the invention is capable of other different obvious aspects all without departing from the invention. Accordingly, the drawings and description will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings.

Reference will now be made in detail to the present preferred embodiment of the invention, an example of which is illustrated in the accompanying drawings, wherein like numerals indicate the same elements throughout the views.

DETAILED DESCRIPTION OF THE PREFERRED EMBODIMENT

Figure 1:
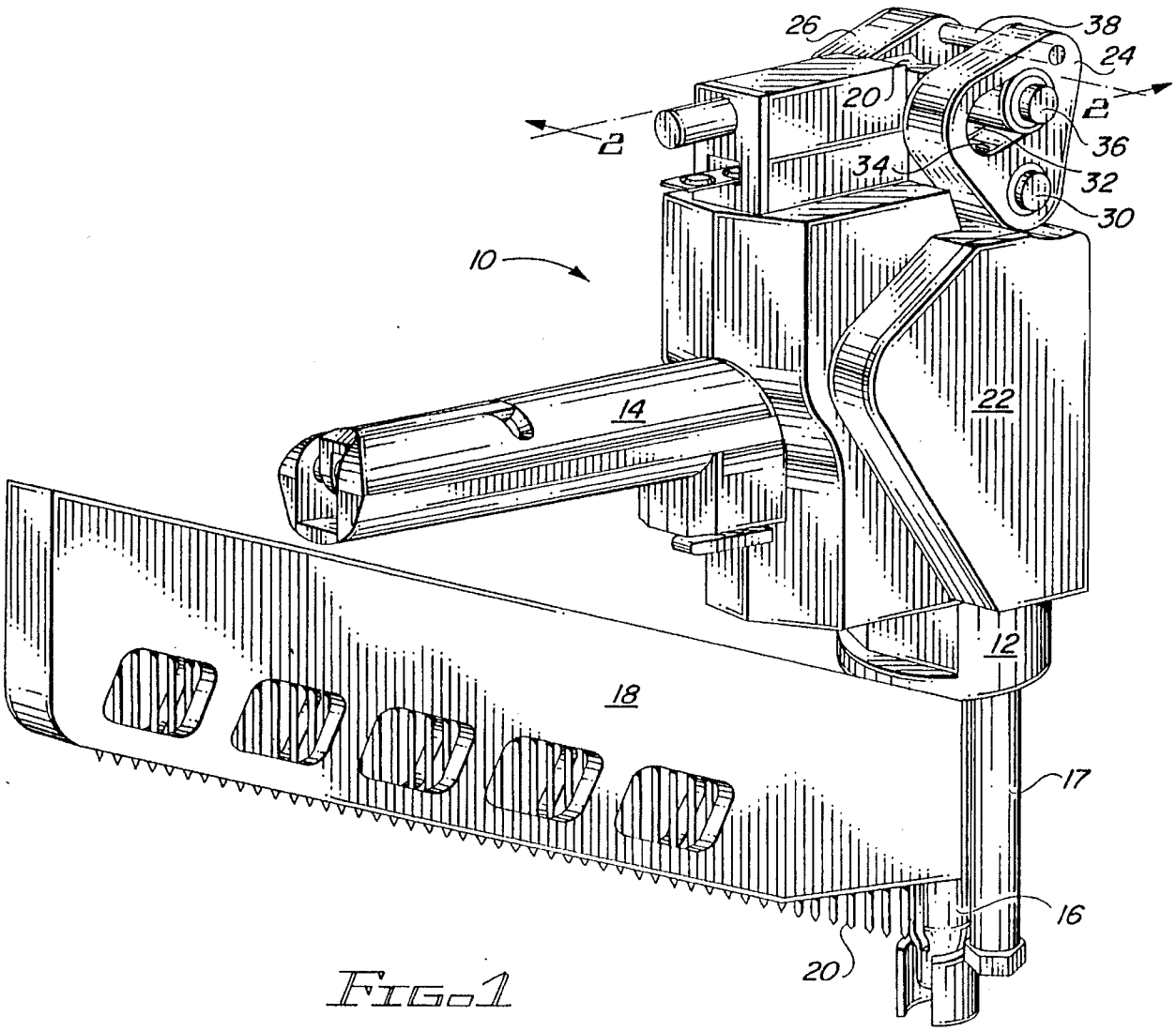
FIG. 1 is a perspective view of a propellant tool for driving nails that is constructed according to the principles of the present invention.

Referring now to the drawings, FIG. 1 is a perspective view of a propellant tool, generally designated by the numeral 10, that is constructed in accordance with the principles of the present invention. The illustrated propellant tool 10 includes a main body 12 which supports a handle 14, a guide body 16 and a pistonless gas spring return assembly 17. As illustrated, the guide body 16 supports a fastener magazine 18 which, in turn, supports a plurality of fasteners, collectively identified by the numeral 20. The fasteners 20, which are specifically shown in the drawing of FIG. 1 as nails, are feed into the guide body 16 where they are contacted by a driver (not shown in FIG. 1, see FIG. 2) and driven into a structure (not shown) to be fastened.

As shown in FIG. 1, the body 12 is partially covered by a muffler 22 used to reduce noise from a combustion chamber (not shown in FIG. 1, see 4). A pair of cams 24,26 are rotatably disposed about the main body 12 to control movement of a chamber block 28 relative to the main body 12. The cams 24,26 each are pivotally mounted on trunions 30 (only one of which is shown in FIG. 1) extending outwardly from the main body 12. Each of the cams 24,26 also has an internal opening 32 defining a cam surface 34 for guiding movement of trunions 36 (only one of which is shown in FIG. 1) extending outwardly from the chamber block 28. The cams 24,26 are interconnected by a cam tie bar 38.

Figure 2:
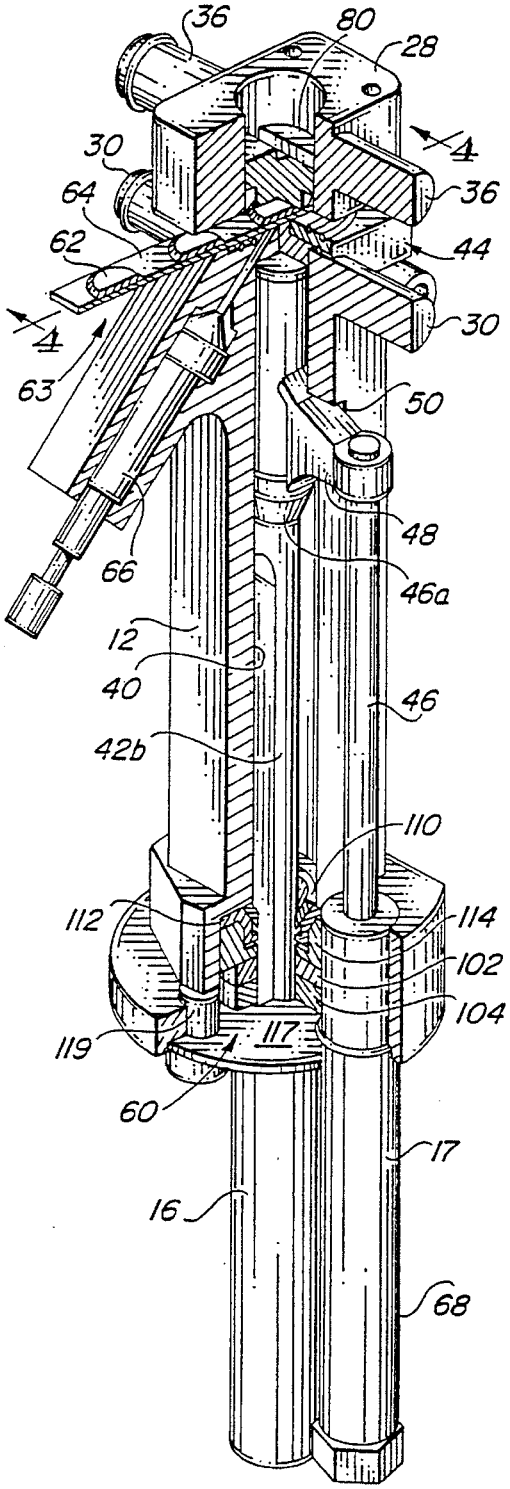
FIG. 2 is an isometric view, partially in cross-section, of the main body of the propellant tool of FIG. 1 depicting an internal cylinder within the body for reciprocally driving a driver and gas return cylinder for returning the driver to a predetermined position with the cross-sectional portion of the cylinder being taken along line 2—2 in FIG. 1.

FIG. 2 shows the main body 12 with various of the outer components of the tool 10 removed. The main body 12 has an internal cylinder 40 in which a driver 42 of generally cylindrical configuration is reciprocally movable. The driver 42 has a piston portion 42*a* at one axial end (the top end as illustrated in FIG. 2). The piston portion 42*a* is connected to a shank portion 42*b* by a frusco-conical seat portion 42*c*. The axial end of the shank portion 42*b* distal to the piston portion 42*a* extends into the guide body 16 and terminates in a driving end (not shown) that is used to contact and successively drive the fasteners 20 into a structure (not shown) positioned adjacent to the distal end of guide body 16, as is conventional in the art. As those skilled in the art will readily appreciate, such driving action of the driver 42 is achieved by axial movement of the driver 42 within the cylinder 40. In the preferred form of the invention, the driver 42 is reciprocally movable between a first retracted position, illustrated in FIG. 2, to an extended position in which the driving end of the driver 42 extends out of the guide body 16. In this extended position, the seat 42*c* of the driver 42 progressively engages a driver stop mechanism, generally identified by the drawing numeral 60. The stop mechanism 60 is illustrated in greater detail in the drawing of FIG. 5.

Figure 3:
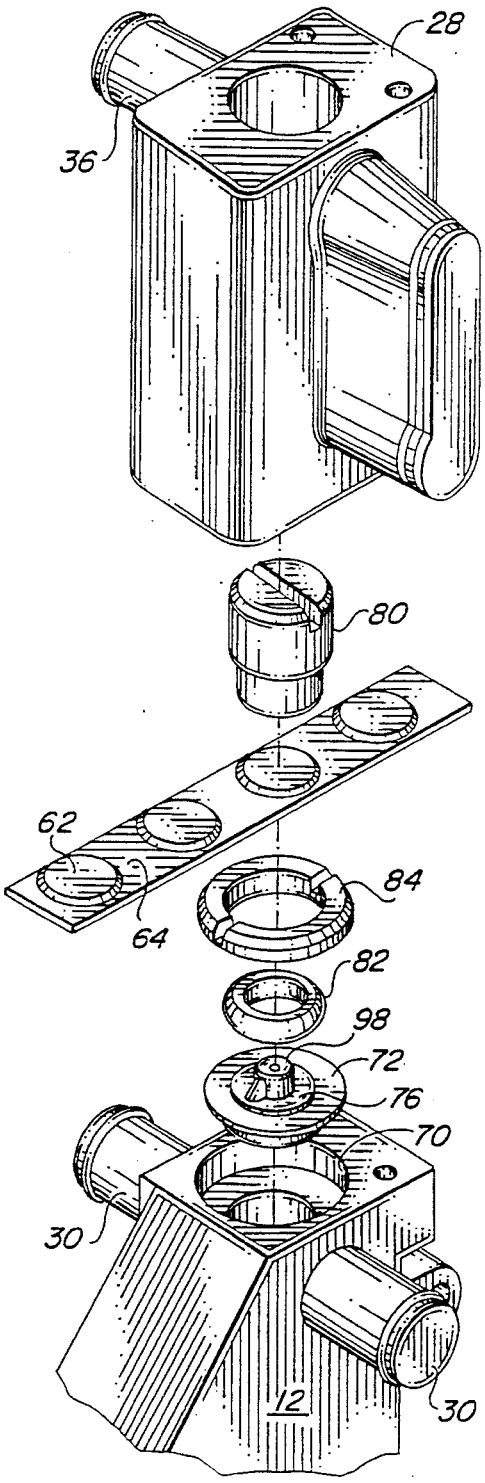
FIG. 3 is an exploded view of ignition chamber of the propellant tool illustrated in FIG. 1 depicting the relationship between the various components of the ignition chamber and a strip of propellant charges.
Figure 4:
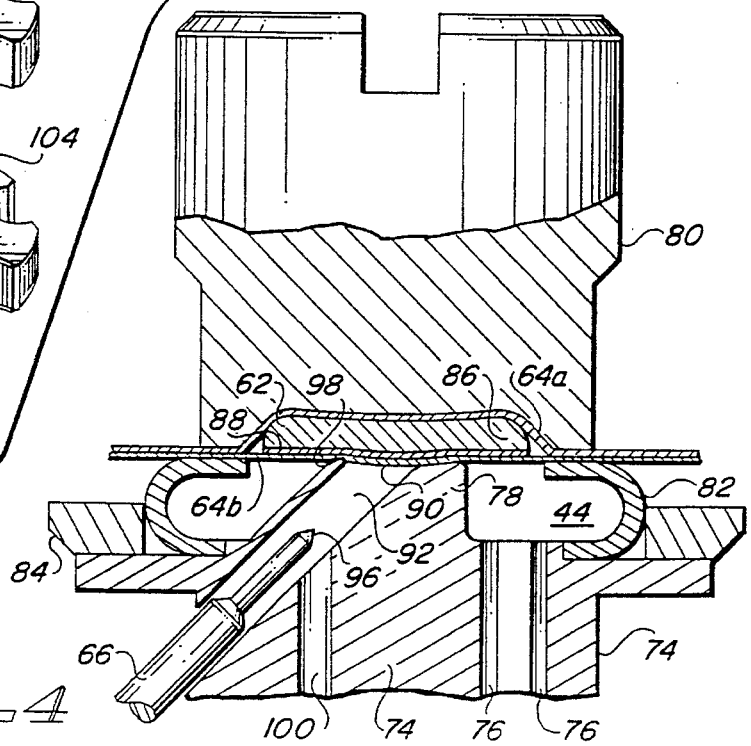
FIG. 4 is a cross-sectional elevational view of the combustion chamber of FIG. 3 taken along line 4—4 in FIG. 2 and depicting a propellant charge compressingly engaged between two relatively movable components of the ignition chamber.

The driver 42 is moved within the cylinder 40 from the retracted to the extended positions under the impetus of pressure formed in a combustion chamber 44 (see FIG. 4) partially located between the chamber block 28 and the main body 12. Pressure is selectively formed in the combustion chamber through the ignition of a caseless propellant charge 62. As depicted in FIGS. 2–4, the caseless charge is introduced into the combustion chamber 44 through a propellant charge inlet passage 63. In the specifically illustrated embodiment, the caseless charge is transported through the inlet passage 63 on a strip 64 formed of paper, plastic or other appropriate material. The propellant charge is ignited in the combustion chamber 44 by a reciprocally movable ignition member 66 in a manner disclosed in greater detail below.

The driver 42 is returned from the extended to the retracted positions by the gas spring return assembly 17 to which the driver 42 is mechanically interconnected. More specifically, a driver cap 48 extends radially outwardly from the piston portion 42*a* of driver 42 and through a slot 50 in the main body 12 to a gas spring rod 46 of the pistonless gas spring return assembly 17. The gas spring rod 46 has a cylindrical configuration (except for a minor taper in the portion disposed within the driver cap 48). The axial end of the gas spring rod 46 opposite the interconnection to the driver cap 48 extends into a closed ended housing 68 containing a sealed compressible fluid that is independent of and segregated from any fluid in the internal cylinder 40 for the driver. When the propellant charge 62 is ignited in combustion chamber 44, the gas spring rod 46 is forced axially into the housing 68 by virtue of the mechanical interconnection between the gas spring rod 46 and the driver 42. This movement of the gas spring rod into the housing 68 compresses the sealed gaseous fluid within housing 68. The pistonless gas spring return assembly 17 then is operative, when combustion pressure within the combustion chamber 44 is reduced, to return the driver 42 to its retracted position (as illustrated in FIG. 2) in response to the increased pressure of the sealed compressible fluid in the gas spring cylinder created when the driver is moved to its extended position.

Referring jointly now to FIGS. 3 and 4, the details of the combustion chamber 44 and the method in which the propellant charge 62 is ignited are shown in greater detail. The propellant charge 62 is advanced into the combustion chamber 44 on strip 64 where the charge 62 is positioned at a predetermined location by clamping the strip 64, thereby locating the propellant change 62 in a secure position between the chamber block 28 and the main body 12. The combustion chamber 44 is partially disposed in a recess 70 formed in the main body 12. The recess 70 is sized and configured to receive and support an orifice plate 74 that is press fit into the recess 70. The orifice plate 74 has a plurality of orifices 76 (see FIG. 4) that provide fluid communication between the combustion chamber 44 and the internal cylinder 40 (see FIG. 2) for the driver 42. A pedestal 78 is integral with and centrally disposed upon the orifice plate 74. The pedestal 78 extends axially outwardly therefrom toward the chamber block 28 into the combustion chamber 44. The chamber block 28 includes axially adjustable chamber top 80 that defines the axial end of the combustion chamber 44 opposite the orifice plate 74. The chamber top 80 cooperates with the pedestal 78 to compressingly engage one of the propellant charges 62 therebetween; as more fully described below.

According to one aspect of the invention, an annular C-ring, preferably formed of a metallic material such as stainless steel or titanium, is interposed between the chamber top 80 and the orifice plate 74 to provide a sealing relation between these two elements. The C-ring, which as it name suggests, has a substantially C-shaped cross-sectional configuration, defines a chamber extending radially outward beyond its axial ends. The C-ring is resiliently expandable under the influence of combustion pressure within the combustion chamber 44, as perhaps most readily apparent from FIG. 4. Such expandability allows the C-ring to retain sealing contact with both the orifice plate 74 and the chamber top 80 as those two elements experience relative axial movement under the influence of combustion pressure. Consequently, the C-ring is operative to increase and enhance sealing pressure between the orifice plate 74 and the chamber top 80 in response to combustion pressure created in the combustion chamber upon ignition of the propellant charge 62. An extended backing ring 84, also supported by the orifice plate 74 is circumferentially disposed about the C-ring 82 and functions to hold the orifice plate 74 in place and entrap the C-ring.

As noted above, the orifice plate 74 has at least one, and in the preferred embodiment, a substantial number (see FIG.

3) of orifices 76 that provide fluid communication between the combustion chamber 44 and the cylinder 40. These orifices preferably are sized to substantially restrict unignited solid components of the propellant charge 62 from entering the cylinder 40. The propellant charges 62 of the preferred embodiment are formed of nitrocellulose fiber and the optional levels of solid component restriction through the orifices 76 are dependent upon the average length of the propellant charge fibers. It has been found that the orifices are optimally sized to have a diametral dimension of approximately one-third the average length of the propellent charge fibers. In the preferred embodiment, the orifices 76 are sized with diameters ranging from 0.010 to 0.070 inches to accomplish this function.

The propellant charge 62 includes a body 86 formed of a first combustible material such as nitrocellulose fibers. In the preferred embodiment, the fibers used to form the primary combustible material 86 have an average length of approximately 0.1 inch. In accordance with another aspect of this invention, the external surface of the propellant charge body 86 is coated with an oxidizer layer 88, which preferably is formed of a mixture of a combustible material and an oxidizer rich material. In the preferred embodiment, the oxidizer coating 88 is formed of a mixture of about 5% to about 60% potassium chlorate by weight and from about 5% to about 80% nitrocellulose by weight. The nitrocellulose used to form the coating 88 may be in the form of fibers, and if so, these fibers would preferably have an average length that is substantially shorter than the average fiber length of the nitrocellulose forming the body 86. Even more preferably, the coating is in the form of a cube or a sphere in order to improve coating properties.

As suggested from jointly viewing FIGS. 3 and 4, the propellant strip 64 is formed of two layers of paper, plastic or other suitable material, a first layer 64*a* and a second layer 64*b*, with the propellant charge 62 being sandwiched between these layers 64*a* and 64*b*. A sensitizer material 90 is deposited onto the outer surface of the layer 64*b* opposite the propellant charge 62. The sensitizer material 90, which is preferably red phosphorus contained in a binder, is located proximal to at least a portion of the oxidizer rich layer 88, but is separated from the oxidizer rich layer 88 by the strip material layer 64*b*.

The propellant charge 62 is positioned in the combustion chamber 44 so as to place the sensitizer material 90 into the path of an ignition member 66, which ignition member 66 is reciprocally movable in a bore 92 extending obliquely through the orifice plate 74. Movement of the ignition member 66, which movement is initiated by depression of a trigger 94 (see FIG. 1) on the tool 10 in a manner well known in the art, causes an firing pin tip 96 on the end of the ignition member 66 to pierce and to be driven into the caseless propellant charge 62. In addition to generating heat due to the friction between the firing pin tip 96 and the sensitizer material 90, such action forces the sensitizer material 90 to be intermixed with the oxidizer coating 88. This interaction initiates decomposition of the oxidizer component within the oxidizer rich coating 88 and generates hot oxygen. In turn, this ignites the fuel component within the oxidizer rich coating 88 and subsequently the combustible material 86.

As is apparent from the above description, the firing pin tip 96 of the ignition member 66 strikes the propellant charge 62 at an oblique angle with respect to the surface of the charge 62 and applies a shearing force against the charge 62. The angle of the ignition member movement also is oblique to the direction of movement of the driver 42 and the relative movement between the chamber block and main body 12.

The pedestal of the orifice plate 74 also advantageously insures complete combustion of the propellant charge 62 by directing ignition gases through the charge 62. As is observable from the depictions of FIGS. 3 and 4, the pedestal 78 compressingly engages an annular surface of the propellant charge 62 and separates the area within that annular surface from those portions of the charge surface that are located radially outwardly therefrom. This is achieved by an annular compression ridge 98 that extends axially upwardly from the pedestal 78. As illustrated in FIG. 4, the firing pin tip 96 of the ignition member 66 strikes the propellant charge 62 within the area defined by the annular ridge 98. The annular compression ridge 98, which is compressingly engaged with the propellant charge 62, is operative to restrict gas flow between the surface of the charge within the annular ridge 98 and those surfaces of the charge 62 outside of the ridge 98. Thus, ignition gases formed by the ignition of the charge 62 within the annular compression ridge 98 are directed radially outwardly through the charge 62. The clearance between the ignition member 66 and the bore 92 are exaggerated in FIG. 4 for purposes of illustration. In practice the clearance is kept very close, as for example within 0.005 inch, to minimize flow of combustion gases through the bore 92. It also will be seen that the bore 92 communicates with a firing pin flush bore 100 that allows flushing of partially combusted propellant charge materials from the bore 92 to prevent fouling of the ignition member 66.

Figure 5:
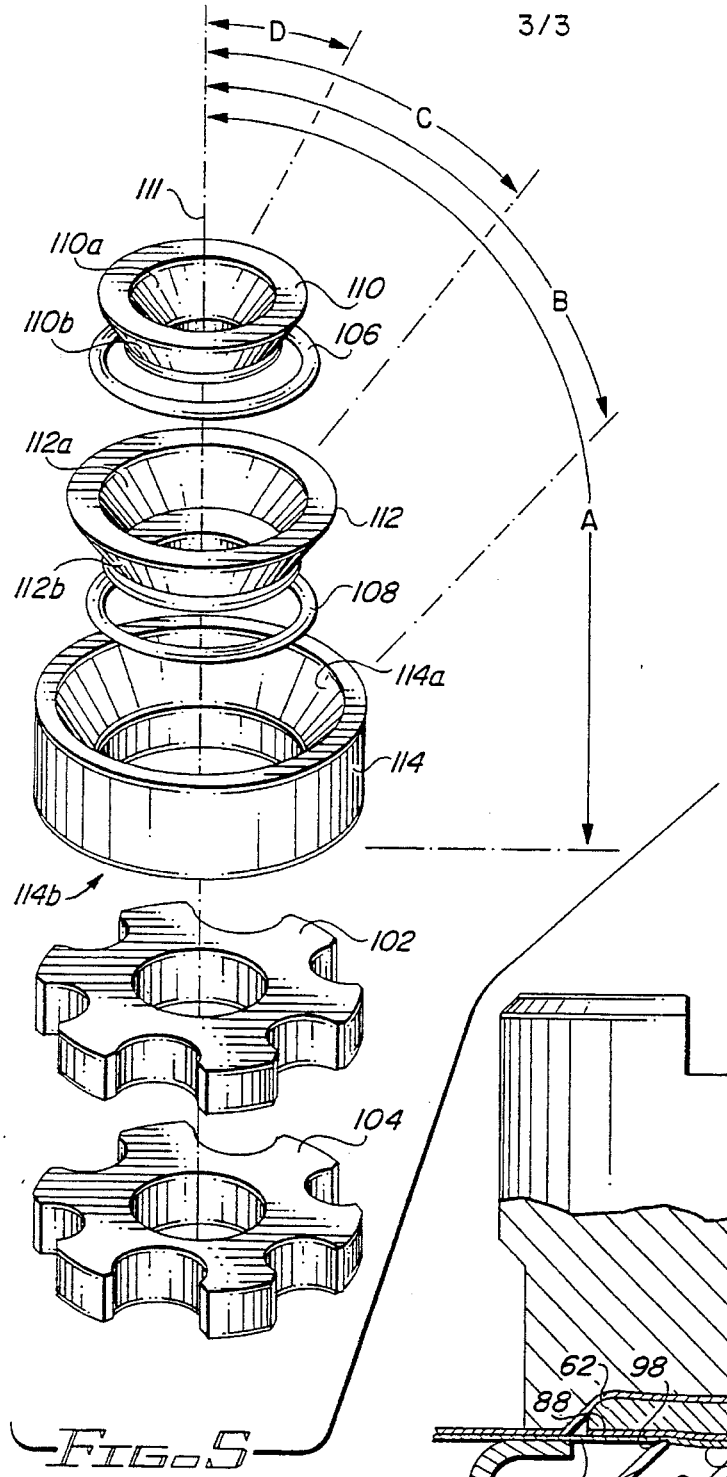
FIG. 5 is an exploded view of the driver stop mechanism illustrated in FIG. 2.

Turning finally to FIG. 5, a portion of the driver stop assembly 60 shown in FIG. 2 is illustrated in greater detail. In the specific form illustrated, the driver stop mechanism 60 includes a number of discrete components that are concentrically disposed about the shank portion 42*b* of driver 42, including two stop pads 102 and 104, two resilient O-rings, 106 and 108, and three serially aligned, progressively sized and telescopically fitting metal cup shaped stop members 110, 112 and 114.

The stop member 110 has two conical contact surfaces, an interior contact surface 110*a*, and an exterior contact surface 110*b*. The stop member 110 is configured with contact surfaces 110*a* and 110*b* each forming an acute angle relative to the longitudinal axis 111 of the driver 42 and with the angle of contact surface 110*b* being greater than that of contact surface 110*a*. Further, the surface area of contact surface 110*b* is greater than that of contact surface 110*a*. The stop member 110 is concentrically disposed about the driver 42 and positioned adjacent to the frusco-conical portion 42*c* so that the interior contact surface 110*a* is contacted by the conical surface 42*c* of the driver when the driver 42 approaches the end of its driving stroke. The contact surface 110*a* of the stop member is sized, configured and adapted to receive the conical surface of 42*c* the driver 42. As illustrated, the contact surface 110*a* has an included angle of approximately 40 degrees, which angle is matched to and approximately the same as the conical surface 42*c* of the driver 42. The contact surface 110*a* is generally symmetrically disposed about the longitudinal axes of the driver 42 and tool cylinder 40, which axes are represented by centerline 111 in FIG. 5.

The stop member 112 is positioned to be contacted by stop member 110 and has a cup-shaped configuration that is similar to that of stop member 110. Like the stop member 110, the stop member 112 has an interior and exterior conical contact surfaces. The interior contact surface is identified by the numeral 112*a* and has an area approximately equal to contact surface 110*b*. The exterior contact surface of stop member 112 is designated by the numeral 112*b* and has a surface area that is greater than that of contact surface 112*a*. The interior contact 112*a* is adapted to receive the contact surface 110*b* when the driver 42 approaches the end of its stroke, and accordingly has an angle approximating that of contact surface 110*b*.

The stop member 114 also has two contact surfaces, an interior conical contact surface 114*a* and a planar contact surface 114*b*. The contact surface 114*a* is adapted to receive and has an angle approximating that of contact surface 112*b*. The surface area of contact surface 114*a* is approximately the same as that of contact surface 112*b*. The planar contact surface 114*b*, which contacts resilient stop pad 102, forms an angle of approximately 90 degrees with respect to the axis 111. The surface area of contact surface 114*b* also is greater than that of contact surface 114*a*.

The driver stop assembly 60 functions to decelerate the driver 42 at the end of its driving stroke. As the driver 42 approaches its fully extended position, the tapered frusco-conical portion 42*c* of the driver 42 initially strikes and contacts the stop member 110. Due to the spacing provided by O-ring 106, the stop member 110 initially is isolated from the mass of stop members 112 and 114. After being impacted by the driver 42, the stop member 110 thereafter is moved axially with the driver 42 against the bias of the O-ring 106. After the resilient O-ring 106 is compressed, the contact surface 110*b* of stop member 110 engages contact surface 112*a* of stop member 112, which stop member 112 thereafter is moved axially to compress O-ring 108. As the stop member 112 is contacted, it is moved axially against the bias of O-ring 108, causing contact surface 112*b* of stop member 112 to engage contact surface 114*a* of stop member 114. This action, in turn, drives the stop member 114 axially to compress the relatively soft resilient stop pad 102 and the relatively hard stop pad 104. As seen in FIG. 2, the stop pad 104 is supported on a base plate 117 that is secured about its periphery to an axial end of the main body 12 by threaded fastener 119 (only one of which is shown in FIG. 2). Any residual energy from the deceleration of the driver 42 is absorbed by the base plate which flexes very slightly at its center portion, and by threaded fastener 119.

In accordance with one aspect of the driver stop assembly, substantially all of the contact force between the driver 42 and stop member 110 is applied through the conical contact surfaces 42*c* and 110*a*. Likewise, substantially all of the contact force between the stop members 110 and 112 is applied through the conical contact surfaces 110*b* and 112*a*. Similarly, substantially all of the contact force between the stop members 112 and 114 is applied through the conical contact surfaces 112*b* and 114*a*. By interfacing substantially exclusively at conical interface surfaces and focusing substantially all of the contact force between the metal stop members 110, 112 and 114 through these conical surfaces, energy is absorbed by the driver stop assembly without the creation of a shear plane or other likely failure point.

According to another aspect of the driver stop assembly 60, the interface angles between the various metal components increase progressively from the driver interface to the interface with the resilient pad 102. As schematically depicted in FIG. 5, the interface angle A between the stop member 114 and the stop pad (approximately 90 degrees) (measured with respect to the axis 111) is greater than the interface angle B between the stop members 112 and 114. The angle B is greater than the angle C between the stop members 110 and 112, which is in turn greater than the interface angle D (approximately 20 degrees) between the driver 42 and the stop member 110. Thus, the interface angle through which the contact force is applied is progressively increased in the illustrated embodiment from approximately a 20 degree interface angle between the driver 42 and the stop member 110 (approximately one half of the included angle of the contact surface 110*a*) to approximately a 90 degree angle between the stop member 114 and the stop pad 102.

As also may be surmised from the drawings, the stop member 114 has a greater mass than stop 112, which in turn, has a greater mass than stop 110. Thus, the effective mass of the driver 42 is increased gradually and non-linearly at an increasing rate to decelerate the driver 42. The stop mechanism 60 causes the driver to decelerate in several different ways. In addition to the deacceleration caused by the progressively increased effective mass of driver 42 created by the stop members 110, 112, and 114, the O-rings 106 and 108, dissipate energy from the driver 42 during compression. The O-rings also function to provide a predetermined spacing between the stop members 110, 112 and 114 prior to contact by the driver 42. This effectively isolates the masses of the stop members 110, 112 and 114 with the result that the dynamics of the upstream stop members are substantially unaffected by the downstream members upon initial impact. The geometries of the driver portion 42*c* and the stop members cause each of the stop members 110, 112 and 114 to undergo hoop stress, further dissipating energy from the driver 42. Any residual energy from the driver is dissipated by the cylinder base plate 12*a* (see FIG. 2), which cylinder base plate is secured to the cylinder by a bolt 117. In addition to their energy absorbing characteristics, the resilient characteristics of the O-rings 106 and 108 provide a predetermined space between the stop members 110, 112 and 114, causing these stop members to be separated when the O-rings 106 and 108 are uncompressed. Hence, while the dynamic interrelationship of the various components becomes somewhat complex at high impact speeds, the illustrated stop assembly 60 generally is designed so that as the effective operative inertial mass of the stop assembly applied to the driver 42 is increased, the speed of the driver 42 is reduced, and the contact surface area between the metal components and the interface angle of the impact are increased progressively.

The foregoing description of a preferred embodiment of the invention has been presented for purposes of illustration and description. It is not intended to be exhaustive or limit the invention to the precise form disclosed, and many modifications and variations are possible in light of the above teaching. The embodiment was chosen and described in order to best explain the principles of the invention and its practical application to thereby enable others skilled in the art to best utilize the invention and various embodiments and with various modifications as are suited to the particular use contemplated. It is intended that the scope of the invention be defined by the claims appended hereto.

We claim:

1. An assembly for decelerating a movable driver in a tool, comprising:

(a) a tool body;

(b) a driver movable in a predetermined direction within the tool body and having a conical contact surface facing the predetermined direction;

(c) a first stop member, said first stop member having first and second conical contact surfaces, the first conical contact surface being adapted to receive the conical contact surface of the driver and being positioned to be contacted by the driver's conical contact surface as the driver is moved in the predetermined direction, the first stop member being movable in the predetermined direction upon being contacted by the conical contact surface of the driver;

(d) a second stop member, the second stop member having a first conical contact surface adapted to receive the second conical contact surface of the first stop member, the second stop member being positioned to be contacted by the second conical contact surface of the first member as the first stop member is moved in the predetermined direction, the second stop member being movable in the predetermined direction upon being contacted by the second conical contact surface of the first stop member; and (e) a resilient spacer for providing a predetermined spacing between the first and second stop members prior to movement of the driver in the predetermined direction, the driver and the first and second stop members being configured and dimensioned such that substantially all of the contact force between the driver and the first stop member is applied through the conical contact surface of the driver and the first conical contact surface of the first stop member and substantially all of the contact force between the first and second members is applied through the second conical contact surface of the first stop member and the first conical contact surface of the second stop member.

2. An assembly as recited in claim 1 wherein the first and second stop members and the spacer are circumferentially disposed about the driver.

3. An assembly as recited in claim 2 wherein the predetermined direction is along a longitudinal axis of the driver and the angle formed by the conical surface of the driver with respect to the axis is approximately equal to the angle formed by the first conical contact surface of the first stop member with respect to the axis.

4. An assembly as recited in claim 3 wherein the angle formed by the second conical contact of the first stop member with respect to the axis is approximately equal to the angle formed by the first conical contact surface of the second stop member with respect to the axis.

5. An assembly as recited in claim 4 wherein the angle formed by the second conical contact surface of the first stop member with respect to the axis is larger than the angle formed by the first conical contact surface of the first stop member with respect to the axis.

6. An assembly as recited in claim 1 wherein the second stop member further includes a second conical contact surface and further including a third stop member having a conical contact surface, the conical contact surface of the third stop member being adapted to receive the second contact surface of the second stop member and being positioned to be contacted by the second conical contact surface of the second stop member as the second stop member is moved in the predetermined direction, a resilient spacer interposed between the second and third stop members for providing a predetermined spacing between the first and second stop members prior to movement of the second stop member in the predetermined direction, the second and third stop members being configured and dimensioned such that substantially all of the contact force between the second and third members is applied through the second conical contact surface of the second stop member and the conical contact surface of the third stop member.

7. An assembly as recited in claim 6 wherein the first and second stop members and the spacer are circumferentially disposed about the driver.

8. An assembly as recited in claim 7 wherein the predetermined direction is along a longitudinal axis of the driver and the angle formed by the conical surface of the driver with respect to the axis is approximately equal to the angle formed by the first conical contact surface of the first stop member with respect to the axis.

9. An assembly as recited in claim 8 wherein the angle formed by the second conical contact of the first stop member with respect to the axis is approximately equal to the angle formed by the first conical contact surface of the second stop member with respect to the axis.

10. An assembly as recited in claim 9 wherein the angle formed by the second conical contact surface of the first stop member with respect to the axis is larger than the angle formed by the first conical contact surface of the first stop member with respect to the axis.

11. An assembly as recited in claim 10 wherein the angle formed by the second conical contact surface of the second stop member with respect to the axis is approximately equal to the angle formed by the conical contact surface of the third stop member.

12. An assembly as recited in claim 11 wherein the angle formed by the second conical contact surface of the second stop member with respect to the axis is larger than the angle formed by the first conical contact surface of the second stop member with respect to the axis.

13. An assembly as recited in claim 12 wherein the first, second and third stop members are supported in the tool body by a base plate, and further including a resilient member interposed between the base plate and the third stop member for absorbing energy resulting from movement of the third stop member in the predetermined direction.

14. An assembly for decelerating a movable driver in a tool, comprising:

(a) a tool body;

(b) a driver movable along its axis within the tool body, the driver having a contact surface forming an acute angle with respect to the axis;

(c) a stop assembly for stopping movement of the driver in the axial direction, the stop assembly being disposed between the contact surface of the driver and a stop structure within the tool body, the stop assembly including a plurality of serially aligned conical stop members that interface with each other at predetermined acute interface angles relative to the axis, the stop member proximal to the driver contact surface forming a first predetermined acute interface angle with the driver contact surface, the stop member most distal to the driver contact surface forming a final interface angle with the stop structure with all predetermined interface angles between the stop members increasing progressively in the direction from the first to the final interface angles.

15. An assembly as recited in claim 14 wherein the final interface angle is substantially perpendicular to the axis.

16. An assembly as recited in claim 15 wherein the stop assembly further includes an elastomeric structure interposed between the stop member most distal to the driver contact surface and the stop structure.

17. An assembly for decelerating a movable driver in a tool, comprising:

(a) a tool body;

(b) a driver movable in a predetermined direction within the tool body and having a conical contact surface facing the predetermined direction;

(c) a first stop member, said first stop member having first and second conical contact surfaces, the first conical contact surface being adapted to receive the conical contact surface of the driver and being positioned to be contacted by the driver's conical contact surface as the driver is moved in the predetermined direction, the first stop member being movable in the predetermined direction upon being contacted by the conical contact surface of the driver; and (d) a second stop member, the second stop member having a first conical contact surface adapted to receive the second conical contact surface of the first stop member, the second stop member being positioned to be contacted by the second conical contact surface of the first member as the first stop member is moved in the predetermined direction, the second stop member being movable in the predetermined direction upon being contacted by the second conical contact surface of the first stop member;

the driver and the first and second stop members being configured and dimensioned such that substantially all of the contact force between the driver and the first stop member is applied through the conical contact surface of the driver and the first conical contact surface of the first stop member and substantially all of the contact force between the first and second members is applied through the second conical contact surface of the first stop member and the first conical contact surface of the second stop member.

18. An assembly as recited in claim 17 further including a resilient spacer for providing a predetermined spacing between the first and second stop members prior to movement of the driver in the predetermined direction, the resilient spacer being concentrically disposed about the driver.

19. An assembly for decelerating a movable driver in a tool, comprising:

(a) a tool body;

(b) a driver movable in a predetermined direction within the tool body and having a conical contact surface facing the predetermined direction;

(c) a first stop member, said first stop member having first and second conical contact surfaces, the first conical contact surface being adapted to receive the conical contact surface of the driver and being positioned to be contacted by the driver's conical contact surface as the driver is moved in the predetermined direction, the first stop member being movable in the predetermined direction upon being contacted by the conical contact surface of the driver;

(d) a second stop member, the second stop member having a first conical contact surface adapted to receive the second conical contact surface of the first stop member, the second stop member being positioned to be contacted by the second conical contact surface of the first member as the first stop member is moved in the predetermined direction, the second stop member being movable in the predetermined direction upon being contacted by the second conical contact surface of the first stop member; and (e) a resilient spacer for providing a predetermined spacing between the first and second stop members prior to movement of the driver in the predetermined direction.

* * * * *